US010557645B2

(12) United States Patent
Zhang

(10) Patent No.: US 10,557,645 B2
(45) Date of Patent: Feb. 11, 2020

(54) METHOD AND SYSTEM FOR PREVENTING FREEZING WHEN FOUR-WAY VALVE IN HEAT PUMP WATER HEATER IS FAILED, AND HEAT PUMP WATER HEATER

(71) Applicants: GD MIDEA HEATING & VENTILATING EQUIPMENT CO., LTD., Foshan (CN); MIDEA GROUP CO., LTD., Foshan (CN)

(72) Inventor: Dengke Zhang, Foshan (CN)

( * ) Notice: Subject to any disclaimer, the term of this patent is extended or adjusted under 35 U.S.C. 154(b) by 204 days.

(21) Appl. No.: 15/501,388

(22) PCT Filed: Apr. 26, 2016

(86) PCT No.: PCT/CN2016/080241
§ 371 (c)(1),
(2) Date: Aug. 9, 2017

(87) PCT Pub. No.: WO2017/071170
PCT Pub. Date: May 4, 2017

(65) Prior Publication Data

US 2017/0261231 A1 Sep. 14, 2017

(30) Foreign Application Priority Data

Oct. 30, 2015 (CN) ..... 2015 1 0732618

(51) Int. Cl.
*F24H 9/20* (2006.01)
*F24H 4/02* (2006.01)

(52) U.S. Cl.
CPC ..... *F24H 9/2007* (2013.01); *F24H 4/02* (2013.01)

(58) Field of Classification Search
CPC . F24H 4/02; F24H 9/2007; F24H 4/04; F24H 9/2021; F24D 19/1054;
(Continued)

(56) References Cited

U.S. PATENT DOCUMENTS

2008/0135636 A1* 6/2008 Sakai ..... F24D 11/0214 237/2 B
2009/0084329 A1* 4/2009 Matsuoka ..... F24H 9/2021 122/14.3
(Continued)

FOREIGN PATENT DOCUMENTS

CN 103471251 A 12/2013
EP 1484561 A1 * 12/2004 ..... F24H 4/04
(Continued)

OTHER PUBLICATIONS

The Office Action dated Jun. 11, 2019 in the corresponding EP application No. 16831559.6.

*Primary Examiner* — Frantz F Jules
*Assistant Examiner* — Martha Tadesse
(74) *Attorney, Agent, or Firm* — Kilpatrick Townsend & Stockton, LLP

(57) ABSTRACT

The present disclosure relates to a method for preventing freezing when a four-way valve in a heat pump water heater is failed, including following acts: S1, it is judged that whether current water temperature T is lower than a preset minimum temperature $T_{min}$ for the water tank, if yes, perform act S2; if no, perform act S1 again; S2, it is judged that whether a cooling rate Td of the current water temperature T is greater than or equal to a preset rate ΔT; or, it is judged that whether the current water temperature T satisfies $T<T_{min}-a$ and whether $T<T_{min}-a$ stands for a first time period t1, in which a is a limit value of a temperature difference; if at least one yes, perform act S3, otherwise, return to act S1; S3, a heat pump system is controlled to stop and an electric auxiliary heating system is started.

7 Claims, 3 Drawing Sheets

(58) Field of Classification Search
CPC .. F24D 17/02; F24D 2220/08; F24D 2200/12; F24D 19/1006; F24D 19/0095
See application file for complete search history.

(56) References Cited

U.S. PATENT DOCUMENTS

| | | | | |
|---|---|---|---|---|
| 2011/0214444 | A1* | 9/2011 | Yoshii | F24H 4/04 62/160 |
| 2012/0291460 | A1* | 11/2012 | Aoyagi | F25B 47/025 62/79 |
| 2012/0304677 | A1* | 12/2012 | Fukunaga | F24H 4/04 62/238.7 |

FOREIGN PATENT DOCUMENTS

| | | | |
|---|---|---|---|
| EP | 1484561 | A1 | 12/2004 |
| EP | 2725305 | A2 | 4/2014 |
| EP | 2725305 | A3 * | 3/2018 |
| WO | 2014188759 | A1 | 11/2014 |

* cited by examiner

METHOD AND SYSTEM FOR PREVENTING FREEZING WHEN FOUR-WAY VALVE IN HEAT PUMP WATER HEATER IS FAILED, AND HEAT PUMP WATER HEATER

CROSS-REFERENCE TO RELATED APPLICATIONS

This application a U.S. national phase application of International Application No. PCT/CN2016/080241, filed with the State Intellectual Property Office of P. R. China on Apr. 26, 2016, which claims priority to and benefits of Chinese Patent Application Serial No. 201510732618.1, filed with the State Intellectual Property Office of P. R. China on Oct. 30, 2015, the entire content of which is incorporated herein by reference.

FIELD

The present disclosure relates to heat pump water heater controlling technology, and more particularly relates to a method and a system for preventing freezing when a four-way valve in a heat pump water heater is failed, and a heat pump water heater.

BACKGROUND

Generally, there is no method for judging whether a four-way valve is failed in an existing heat pump water heater system. If the four-way valve is failed, a refrigeration is performed and low-temperature water in a water tank may freeze, such that water inlet of the water tank may be blocked due to ice blockage, thus seriously affecting a usage of a user.

In some cases, the heat pump water heater in related arts may judge whether the four-way valve is failed by determining a difference between temperature of a heat exchanger and environment temperature. In most instances, this solution is feasible; but in a low temperature condition and a condition of low-temperature water, this solution is failed, i.e., the solution cannot be used to judge whether the four-way valve is failed, or in some cases a misjudgment may occur when using this solution.

SUMMARY

Embodiments of the present disclosure provide a method and a system for preventing freezing when a four-way valve in a heat pump water heater is failed to address the misjudgment problem occurring when judging whether the four-way valve is failed.

In order to address the above technical problem, embodiments of the present disclosure provide a method for preventing freezing when a four-way valve in a heat pump water heater is failed. The method includes following acts.

In act S1, it is judged whether current water temperature T of water in a lower part of a water tank is lower than a preset minimum temperature $T_{min}$ for the water tank, if yes, act S2 is executed; if no, act S1 is executed repeatedly.

In act S2, it is judged whether a cooling rate Td of the current water temperature T is greater than or equal to a preset rate ΔT;

or, it is judged whether the current water temperature T satisfies $T<T_{min}-a$ and whether $T<T_{min}-a$ stands for a first time period t1, in which a is a limit value of a temperature difference;

if at least one of the above judgment results is positive, act S3 is executed, otherwise, act S1 is executed.

In act S3, a heat pump system is controlled to stop and an electric auxiliary heating system is started.

Embodiments of the present disclosure also provide a system for preventing freezing when a four-way valve in a heat pump water heater is failed. The system includes a first judging module, a second judging module and a first controlling module.

The first judging module is configured to judge whether a current water temperature T of water in a lower part of a water tank is lower than a preset minimum temperature $T_{min}$ for the water tank. If yes, the second judging module is invoked.

The second judging module is configured to judge whether a cooling rate Td of the current water temperature T is greater than or equal to a preset rate ΔT;

or to judge whether the current water temperature T satisfies $T<T_{min}-a$ and whether $T<T_{min}-a$ stands for a first time period t1, in which a is a limit value of a temperature difference.

If at least one of the judgment results is positive, the first controlling module is invoked; otherwise, the first judging module is invoked.

The first controlling module is configured to control a heat pump system to stop and to start an electric auxiliary heating system.

Embodiments of the present disclosure provide a method for preventing freezing when a four-way valve in a heat pump water heater is failed. The method includes: detecting a current water temperature T of water in a lower part of a water tank, and judging whether the current water temperature T is lower than a preset minimum temperature $T_{min}$ for the water tank; judging whether the current water temperature T satisfies a preset condition if the current water temperature T is lower than the preset minimum temperature $T_{min}$ for the water tank; and controlling a heat pump system to stop and starting an electric auxiliary heating system if the current water temperature T satisfies the preset condition.

Embodiments of the present disclosure provide a system for preventing freezing when a four-way valve in a heat pump water heater is failed. The system includes: a detecting module, a first judging module, a second judging module and a first controlling module, in which the detecting module is configured to detect a current water temperature T of water in a lower part of a water tank; the first judging module is configured to judge whether the current water temperature T is lower than a preset minimum temperature $T_{min}$ for the water tank; the second judging module is configured to judge whether the current water temperature T satisfies a preset condition if the current water temperature T is lower than the preset minimum temperature $T_{min}$ for the water tank; and the first controlling module is configured to control a heat pump system to stop and to start an electric auxiliary heating system if the current water temperature T satisfies the preset condition.

Additionally, embodiments of the present disclosure also provide a heat pump water heater including the system mentioned above.

Figure 1:
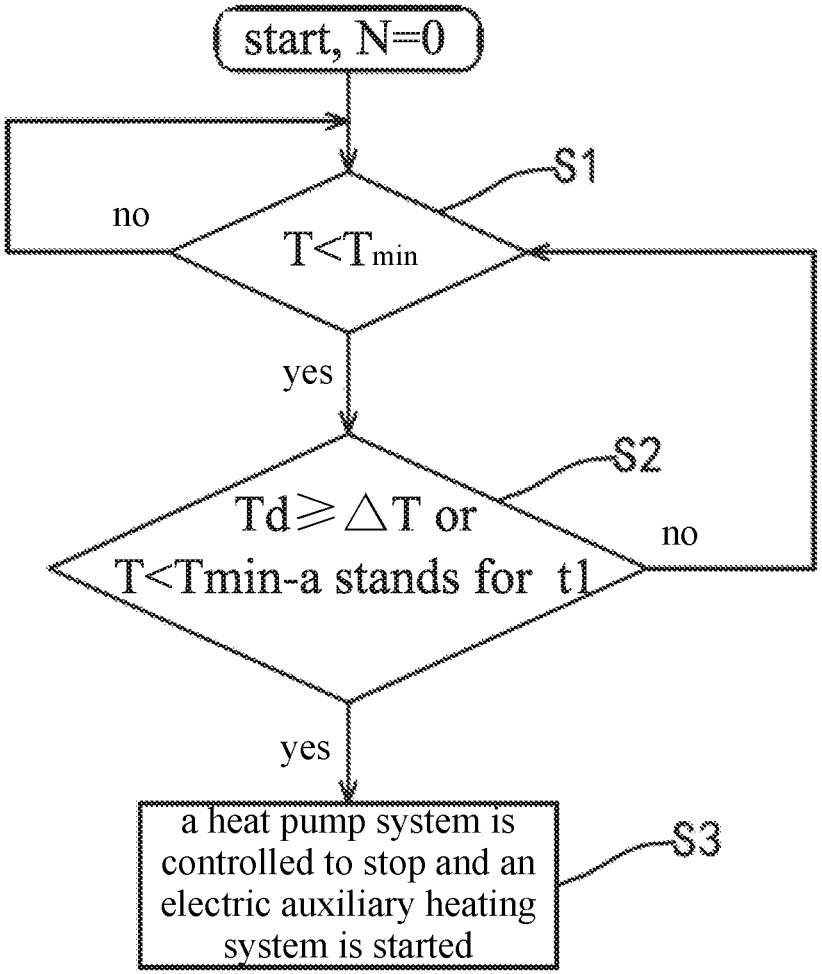
FIG. 1 is a control flow chart of a method for preventing freezing when a four-way valve in a heat pump water heater is failed according to a first embodiment of the present disclosure.

In accompanying drawings, reference numerals representing different components are listed as follows:

100: first judging module, 200: second judging module, 300: first controlling module, 400: third judging module, 500: second controlling module, 600: fourth judging module, 700: failure number counting module, and 800: fifth judging module.

DETAILED DESCRIPTION

Embodiments of the present disclosure will be described in detail with reference to the drawings.

A control flow chart of a method for preventing freezing when a four-way valve in a heat pump water heater is failed according to a first embodiment of the present disclosure is shown in FIG. 1. The method includes following acts.

In act S1, it is judged whether current water temperature T of water in a lower part of a water tank is lower than preset minimum temperature $T_{in}$ for the water tank, if yes, act S2 is executed; if no, act S1 is executed repeatedly.

In act S2, it is judged whether a cooling rate Td of the current water temperature T is greater than or equal to a preset rate ΔT;

or, it is judged whether the current water temperature T satisfies $T<T_{min}-a$ and whether $T<T_{min}-a$ stands for a first time period t1, in which a is a limit value of a temperature difference;

if at least one of the judgment results is positive, act S3 is executed, otherwise, act S1 is executed.

In act S3, a heat pump system is controlled to stop and an electric auxiliary heating system is started.

By judging whether a cooling rate Td of the current water temperature T is greater than or equal to a preset rate ΔT; or by judging whether the current water temperature T satisfies $T<T_{min}-a$ and whether $T<T_{min}-a$ stands for a first time period t1, it may be judged precisely whether the four-way valve is failed, thus avoiding a misjudgment.

Figure 2:
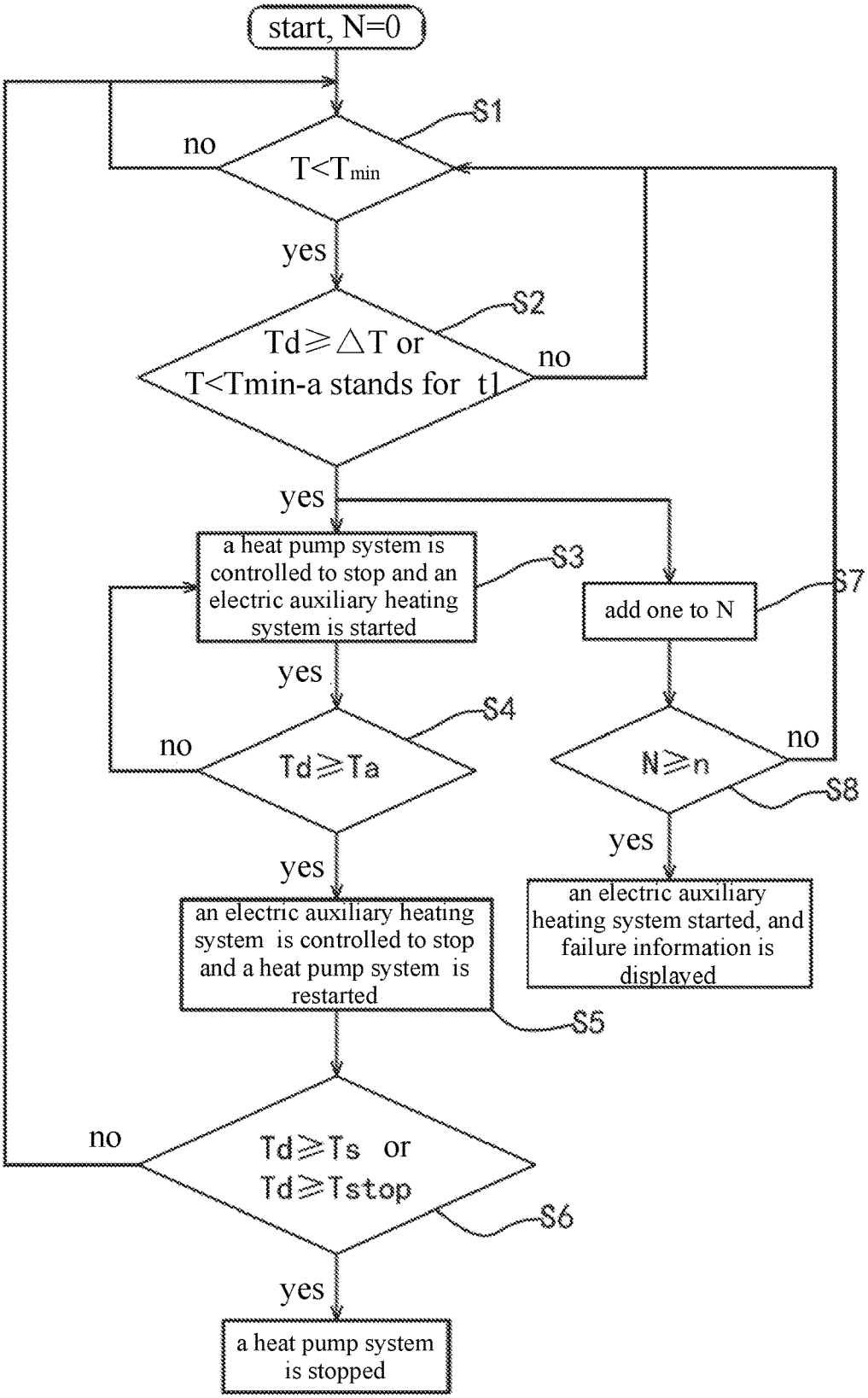
FIG. 2 is another control flow chart of the method for preventing freezing when the four-way valve in the heat pump water heater is failed according to a second embodiment of the present disclosure.

Another control flow chart of the method for preventing freezing when the four-way valve in the heat pump water heater is failed according to a second embodiment of the present disclosure is shown in FIG. 2. Compared to the first embodiment, the difference is that after act S3, the method also includes following acts.

In act S4, it is judged whether the current water temperature T is greater than or equal to temperature Ta. If yes, act S5 is executed; otherwise, act S3 is executed.

In act S5, the electric auxiliary heating system is controlled to stop and the heat pump system is restarted.

After the electric auxiliary heating system is started to assist the heat pump water heater in heating, the electric auxiliary heating system is controlled to stop and the heat pump system is restarted if the current water temperature T is greater than or equal to temperature Ta. In this way, the heat pump water heater may be controlled to return to normal after judging that the four-way valve is recovered.

If it is judged that the current water temperature T is greater than or equal to preset water tank temperature Ts or that the current water temperature T is greater than or equal to maximum temperature $T_{stop}$ of the water heated by the heat pump water heater, the heat pump system is controlled to stop, such that the heat pump water heater system may be protected from breakdown.

After S5, the method also includes following acts.

In act S6, it is judged whether the current water temperature T is greater than or equal to preset water tank temperature Ts; or it is judged whether the current water temperature T is greater than or equal to maximum temperature $T_{stop}$ of the water heated by the heat pump water heater. If at least one of the judgment results is positive, the heat pump system is controlled to stop; otherwise, act S1 is executed.

In act S2, it is judged whether a cooling rate Td of the current water temperature T is greater than or equal to a preset rate ΔT;

or, it is judged whether the current water temperature T satisfies $T<T_{min}-a$ and whether $T<T_{min}-a$ stands for a first time period t1, in which a is a limit value of a temperature difference;

if at least one of the judgment results is positive, the following acts are executed.

In act S7, one is added to a number N of failures of the four-way valve.

In act S8, it is judged whether the number N is greater than or equal to a preset number n. If yes, the heat pump system is stopped, the electric auxiliary heating system is started and failure information is displayed; otherwise, act S1 is executed.

By judging that the four-way valve is recovered, the heat pump water heater may be controlled to return to normal. If it is judged that the current water temperature T is greater than or equal to preset water tank temperature Ts; or that the current water temperature T is greater than or equal to maximum temperature $T_{stop}$ of the water heated by the heat pump water heater, the heat pump system is controlled to stop, such that the heat pump water heater system may be protected from breakdown. If it is judged that the number of failures of the four-way valve is greater than or equal to the preset number n, it may be determined that the four-way valve is failed, such that the heat pump system is stopped to protect the heat pump water heater.

Further, the preset rate ΔT ranges from 0.05° C./min to 1° C./min.

The above further solution may include the following advantageous effects: the preset rate ΔT ranging from 0.05° C./min to 1° C./min is reasonable to ensure validity of judgment whether the four-way valve in the heat pump water heater is failed.

Further, a ranges from 1° C. to 5° C.

The above further solution may include the following advantageous effects: a ranging from 1° C. to 5° C. is reasonable to ensure accuracy of judgment whether the four-way valve in the heat pump water heater is failed.

Further, the first time period t1 ranges from 1 minute to 10 minutes.

The above further solution may include the following advantageous effects: by assigning different values to the first time period t1 according to different conditions of the heat pump water heater system, validity of judgment whether the four-way valve in the heat pump water heater is failed is ensured.

Further, the preset number n ranges from 2 to 5.

The above further solution may include the following advantageous effects: by assigning a value ranging from 2 to 5 to the preset number n, a protection of the heat pump water heater is ensured.

Figure 3:
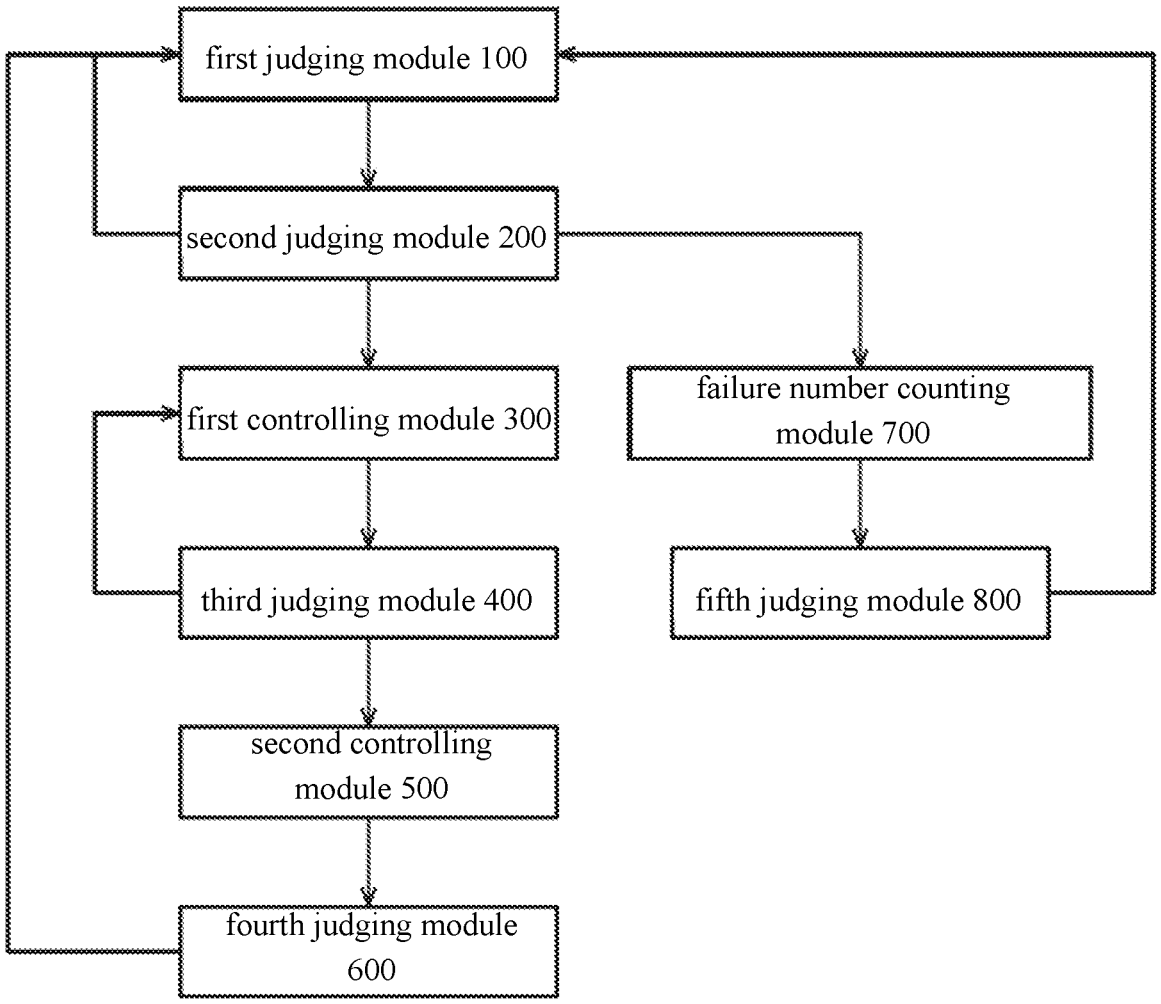
FIG. 3 is a block diagram of a system for preventing freezing when a four-way valve in a heat pump water heater is failed according to an embodiment of the present disclosure.

A block diagram of a system for preventing freezing when a four-way valve in a heat pump water heater is failed according to an embodiment of the present disclosure is shown in FIG. 3. The system includes: a first judging module 100, a second judging module 200 and a first controlling module 300.

The first judging module 100 is configured to judge whether the current water temperature T is lower than a preset minimum temperature $T_{min}$ for the water tank. If yes, the second judging module 200 is invoked.

The second judging module 200 is configured to judge whether a cooling rate Td of the current water temperature T is greater than or equal to a preset rate ΔT;

or to judge whether the current water temperature T satisfies $T<T_{min}-a$ and whether $T<T_{min}-a$ stands for a first time period t1, in which a is a limit value of a temperature difference.

If at least one of the judgment results is positive, the first controlling module 300 is invoked; otherwise, the first judging module 100 is invoked.

The first controlling module 300 is configured to control a heat pump system to stop and to start an electric auxiliary heating system.

The system also includes a third judging module 400, a second controlling module 500, a fourth judging module 600, a failure number counting module 700 and a fifth judging module 800.

The third judging module 400 is configured to judge whether the current water temperature T is greater than or equal to temperature Ta. If yes, the second controlling module 500 is invoked; otherwise, the first controlling module 300 is invoked.

The second controlling module 500 is configured to control the electric auxiliary heating system to stop and to restart the heat pump system.

The fourth judging module 600 is configured to judge whether the current water temperature T is greater than or equal to preset water tank temperature Ts, or to judge whether the current water temperature T is greater than or equal to maximum temperature $T_{stop}$ of the water heated by the heat pump water heater. If at least one of the judgment results is positive, the heat pump system is controlled to stop; otherwise, the first judging module 100 is invoked.

The second judging module 300 is configured to judge whether a cooling rate Td of the current water temperature T is greater than or equal to a preset rate ΔT;

or to judge whether the current water temperature T satisfies $T<T_{min}-a$ and whether $T<T_{min}-a$ stands for a first time period t1, in which a is a limit value of a temperature difference.

If at least one of the judgment results is positive, the failure number counting module 700 is invoked then.

The failure number counting module 700 is configured to add one to a number N of failures of the four-way valve.

The fifth judging module 800 is configured to judge whether the number N is greater than or equal to a preset number n. If yes, the heat pump system is stopped, the electric auxiliary heating system is started, and the failure information is displayed; otherwise, the first judging module 100 is invoked.

By judging whether a cooling rate Td of the current water temperature T is greater than or equal to a preset rate ΔT or judging whether the current water temperature T satisfies $T<T_{min}-a$ and whether $T<T_{min}-a$ stands for a first time period t1 by means of the second judging module, and by controlling the heat pump system to stop and starting the electric auxiliary heating system by means of the first controlling module, it may be judged precisely whether the four-way valve is failed, such that a misjudgment may be avoided. Accuracy and validity of judgment whether the four-way valve in the heat pump water heater is failed is ensured by means of the third judging module, the second controlling module, the fourth judging module, the failure number counting module and the fifth judging module.

In embodiments of the present disclosure, the preset rate ΔT ranges from 0.05° C./min to 1° C./min, the preset rate ΔT ranges from 0.05° C./min to 1° C./min, a ranges from 1° C. to 5° C., the first time period t1 ranges from 1 minute to 10 minutes and the preset number n ranges from 2 to 5. Thus, accuracy and validity of judgment whether the four-way valve in the heat pump water heater is failed may be ensured.

Embodiments of the present disclosure provide a method for preventing freezing when a four-way valve in a heat pump water heater is failed. The method includes: detecting a current water temperature T of water in a lower part of a water tank, and judging whether the current water temperature T is lower than a preset minimum temperature $T_{min}$ for the water tank; judging whether the current water temperature T satisfies a preset condition if the current water temperature T is lower than the preset minimum temperature $T_{min}$ for the water tank; and controlling a heat pump system to stop and starting an electric auxiliary heating system if the current water temperature T satisfies the preset condition.

With the method according to embodiments of the present disclosure, by detecting the current water temperature T of the water in the lower part of the water tank so as to judge whether the four-way valve in the heat pump water heater is failed, and by controlling a heat pump system to stop and starting an electric auxiliary heating system if the four-way valve is failed, a blockage in water inlet of the water tank due to a failure of the four-way valve may be avoided effectively, which may satisfy a user to use hot water normally. At a same time, a misjudgment may be avoided effectively, accuracy of judgment whether the four-way valve in the heat pump water heater is failed may be improved.

According to an embodiment of the present disclosure, judging whether the current water temperature T satisfies a preset condition includes: judging whether a cooling rate Td of the current water temperature T is greater than or equal to a preset rate ΔT, and/or judging whether the current water temperature T satisfies $T<T_{min}-a$ and whether $T<T_{min}-a$ stands for a first time period t1, in which it is judged that the current water temperature T satisfies the preset condition if the cooling rate Td of the current water temperature T is greater than or equal to the preset rate ΔT, and/or if the current water temperature T satisfies $T<T_{min}-a$ and $T<T_{min}-a$ stands for the first time period t1, in which a is a limit value of a temperature difference.

According to an embodiment of the present disclosure, after controlling a heat pump system to stop and starting an electric auxiliary heating system, the method also includes: judging whether the current water temperature T is greater than or equal to a temperature Ta; and controlling the electric auxiliary heating system to stop and restarting the heat pump system if the current water temperature T is greater than or equal to the temperature Ta.

According to an embodiment of the present disclosure, after controlling the electric auxiliary heating system to stop and restarting the heat pump system, the method also includes: judging whether the current water temperature T is greater than or equal to a preset water tank temperature Ts, and/or judging whether the current water temperature T is greater than or equal to a maximum temperature $T_{stop}$ of the water heated by the heat pump water heater; and controlling the heat pump water heater to stop, if the current water temperature T is greater than or equal to the preset water tank temperature Ts, and/or if the current water temperature T is greater than or equal to the maximum temperature $T_{stop}$.

According to an embodiment of the present disclosure, if the current water temperature T satisfies the preset condition, the method also includes: adding one to a number N of failures of the four-way valve, and judging whether the number N is greater than or equal to a preset number n; and displaying failure information if the number N is greater than or equal to the preset number n.

Specifically, the preset number n ranges from 2 to 5.

Specifically, the preset rate ΔT ranges from 0.05° C./min to 1° C./min.

Specifically, a ranges from 1° C. to 5° C. and the first time period t1 ranges from 1 minute to 10 minutes.

Embodiments of the present disclosure provide a system for preventing freezing when a four-way valve in a heat pump water heater is failed. The system includes: a detecting module, a first judging module, a second judging module and a first controlling module, in which the detecting module is configured to detect a current water temperature T of water in a lower part of a water tank; the first judging module is configured to judge whether the current water temperature T is lower than a preset minimum temperature $T_{min}$ for the water tank; the second judging module is configured to judge whether the current water temperature T satisfies a preset condition if the current water temperature T is lower than the preset minimum temperature $T_{min}$ for the water tank; and the first controlling module is configured to control a heat pump system to stop and to start an electric auxiliary heating system if the current water temperature T satisfies the preset condition.

With the system according to embodiments of the present disclosure, by detecting the current water temperature T of the water in the lower part of the water tank so as to judge whether the four-way valve in the heat pump water heater is failed, and by controlling a heat pump system to stop and starting an electric auxiliary heating system if the four-way valve is failed, a blockage in water inlet of the water tank due to a failure of the four-way valve may be avoided effectively, and a requirement of a user to use hot water normally may be satisfied. Further, a misjudgment may be avoided effectively, accuracy of judgment whether the four-way valve in the heat pump water heater is failed may be improved.

According to an embodiment of the present disclosure, the second judging module is configured to judge whether the current water temperature T satisfies a preset condition by judging whether a cooling rate Td of the current water temperature T is greater than or equal to a preset rate ΔT, and/or judging whether the current water temperature T satisfies $T<T_{min}-a$ and whether $T<T_{min}-a$ stands for a first time period t1, in which the second judging module judges that the current water temperature T satisfies the preset condition if the cooling rate Td of the current water temperature T is greater than or equal to the preset rate ΔT, and/or if the current water temperature T satisfies $T<T_{min}-a$ and $T<T_{min}-a$ stands for the first time period t1, in which a is a limit value of a temperature difference.

According to an embodiment of the present disclosure, the system also includes a third judging module and a second controlling module, in which the third judging module is configured to judge whether the current water temperature T is greater than or equal to a temperature Ta, after the heat pump system is stopped and the electric auxiliary heating system is started; and the second controlling module is configured to control the electric auxiliary heating system to stop and to restart the heat pump system, if the current water temperature T is greater than or equal to the temperature Ta.

According to an embodiment of the present disclosure, the system also includes a fourth judging module, in which the fourth judging module is configured to judge whether the current water temperature T is greater than or equal to a preset water tank temperature Ts, and/or to judge whether the current water temperature T is greater than or equal to a maximum temperature $T_{stop}$ of the water heated by the heat pump water heater after the electric auxiliary heating system is stopped and the heat pump system is restarted; and the first controlling module is configured to control the heat pump water heater to stop, if the current water temperature T is greater than or equal to the preset water tank temperature Ts, and/or if the current water temperature T is greater than or equal to the maximum temperature $T_{stop}$.

According to an embodiment of the present disclosure, the system also includes a failure number counting module and a fifth judging module, in which the failure number counting module is configured to add one to a number N of failures of the four-way valve when the current water temperature T satisfies the preset condition; the fifth judging module is configured to judge whether the number N is greater than or equal to a preset number n; and the first controlling module is further configured to control the heat pump water heater to display failure information if the number N is greater than or equal to the preset number n.

Additionally, embodiments of the present disclosure also provide a heat pump water heater including the system mentioned above.

With the heat pump water heater according to embodiments of the present disclosure, it may be judged precisely whether the four-way valve is failed, and a heat pump system is stopped and an electric auxiliary heating system is started if the four-way valve is failed, such that a blockage in water inlet of the water tank due to a failure of the four-way valve may be avoided effectively, and a requirement of user to use hot water normally may be satisfied. Further, a misjudgment may be avoided effectively, accuracy of judgment whether the four-way valve in the heat pump water heater is failed may be improved.

In the specification, it should be understood that relative terms such as "central", "longitudinal", "lateral", "upper", "lower", "vertical", "horizontal", "top", "bottom", "inner", should be construed to refer to the orientation as then described or as shown in the drawings under discussion. These relative terms are for convenience of description and do not require that the present disclosure be constructed or operated in a particular orientation, which are not intended to limit the present disclosure.

In the description of embodiments of the present disclosure, it is to be understood that, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the embodiments of the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

A method and a system for preventing freezing when a four-way valve in a heat pump water heater is failed are described above in detail. Specific embodiments are used to describe principles and implementations of the present disclosure. The descriptions of embodiments are provided to understand the core spirit of the preset disclosure, and those skilled in the art may use different methods to implement the described functions according to the spirit of the present disclosure. Therefore, the present disclosure is not limited to the embodiments.

What is claimed is:

1. A system for preventing freezing when a four-way valve in a heat pump water heater is failed, comprising:

a processor; a memory storing instructions executable by the processor; wherein, the processor is configured to: detect a current water temperature T of water in a lower part of a water tank;

judge whether the current water temperature T is lower than a preset minimum temperature $T_{min}$ for the water tank; judge whether the current water temperature T satisfies a preset condition if the current water temperature T is lower than the preset minimum temperature $T_{min}$ for the water tank; and control a heat pump system to stop and to start an electric auxiliary heating system, if the current water temperature T satisfies the preset condition, wherein the processor is further configured to:

judge whether the current water temperature T is greater than or equal to a preset water tank temperature $T_s$, and/or to judge whether the current water temperature T is greater than or equal to a maximum temperature $T_{sop}$ of the water heated by the heat pump water heater, after the electric auxiliary heating system is stopped and the heat pump system is restarted; and the processor is configured to control the heat pump water heater to stop, if the current water temperature T is greater than or equal to the preset water tank temperature $T_s$, and/or if the current water temperature T is greater than or equal to the maximum temperature $T_{stop}$, wherein the processor is further configured to: add one to a number N of failures of the four-way valve when the current water temperature T satisfies the preset condition;

judge whether the number N is greater than or equal to a preset number n; and the processor is configured to control a heat pump system to stop and to start an electric auxiliary heating system and to control the heat pump water heater to display failure information, if the number N is greater than or equal to the preset number n.

2. The system according to claim 1, wherein the processor is configured to judge whether the current water temperature T satisfies a preset condition by judging whether a cooling rate Td of the current water temperature T is greater than or equal to a preset rate ΔT, and/or judging whether the current water temperature T satisfies $T<T_{min}-a$ and whether $T<T_{min}-a$ stands for a first time period t1, wherein the processor judges that the current water temperature T satisfies the preset condition if the cooling rate Td of the current water temperature T is greater than or equal to the preset rate ΔT, and/or if the current water temperature T satisfies $T<T_{min}-a$ and whether $T<T_{min}-a$ stands for a first time period t1, wherein a is a limit value of a temperature difference.

3. The system according to claim 1, wherein the processor is further configured to:

judge whether the current water temperature T is greater than or equal to a temperature Ta, after the heat pump system is stopped and the electric auxiliary heating system is started; and control the electric auxiliary heating system to stop and to restart the heat pump system, if the current water temperature T is greater than or equal to the temperature Ta.

4. A heat pump water heater, comprising the system according to claim 1.

5. The system according to claim 1, wherein the preset number n ranges from 2 to 5.

6. The system according to claim 2, wherein the preset rate ΔT ranges from 0.05° C./min to 1° C./min.

7. The system according to claim 2, wherein a ranges from 1° C. to 5° C. and the first time period t1 ranges from 1 minute to 10 minutes.

* * * * *